US005850941A

United States Patent [19]

Johnson et al.

[11] Patent Number: 5,850,941

[45] Date of Patent: Dec. 22, 1998

[54] TOY WATER GUN WITH AIR SIPHONING VALVE

[75] Inventors: Lonnie G. Johnson, Smyrna; Shane Matthews, Marietta, both of Ga.

[73] Assignee: Johnson Research & Development Company, Inc., Smyrna, Ga.

[21] Appl. No.: 780,574

[22] Filed: Jan. 8, 1997

[51] Int. Cl.[6] ..... A63H 3/18

[52] U.S. Cl. ..... 222/79; 222/394; 222/1

[58] Field of Search ..... 222/79, 394, 630, 222/1; 239/373; 141/18, 67, 100, 105, 382

[56] References Cited

U.S. PATENT DOCUMENTS

| | | | |
|---|---|---|---|
| D. 78,206 | 4/1929 | Hermann . | |
| D. 159,040 | 7/1950 | Bicos | D30/1 |
| D. 265,221 | 6/1982 | Hardin | D21/147 |
| D. 285,327 | 8/1986 | Yano | D21/147 |
| D. 297,748 | 9/1988 | Marino | D21/147 |
| D. 303,820 | 10/1989 | Wong | D21/147 |
| D. 318,309 | 7/1991 | D'Andrade | D21/147 |
| D. 336,939 | 6/1993 | Salmon et al. | D21/147 |
| D. 338,697 | 8/1993 | Salmon et al. | D21/147 |
| D. 340,750 | 10/1993 | Salmon et al. | D21/147 |
| D. 341,174 | 11/1993 | Salmon et al. | D21/147 |
| 1,964,345 | 7/1934 | Feller . | |
| 2,049,194 | 7/1936 | Chapin | 43/147 |
| 2,303,510 | 12/1942 | Swebilius | 42/69 |
| 3,197,070 | 7/1965 | Pearl | 222/79 |
| 3,273,553 | 9/1966 | Doyle | 124/3 |
| 3,794,789 | 2/1974 | Bynum | 200/83 Z |
| 4,022,350 | 5/1977 | Amron | 222/790 |
| 4,160,513 | 7/1979 | Cockerman | 222/181 |
| 4,214,674 | 7/1980 | Jones et al. | 222/79 |
| 4,257,460 | 3/1981 | Paranay et al. | 141/382 |
| 4,441,629 | 4/1984 | Mackal | 222/324 |
| 4,509,659 | 4/1985 | Cloutier et al. | 222/41 |
| 4,591,071 | 5/1986 | Johnson | 222/39 |
| 4,706,848 | 11/1987 | D'Andrade | 222/79 |
| 4,743,030 | 5/1988 | Auer et al. | 273/349 |
| 4,750,641 | 6/1988 | Hun | 222/798 |
| 4,757,946 | 7/1988 | Johnson | 239/99 |
| 4,875,508 | 10/1989 | Burke et al. | 141/2 |
| 4,955,512 | 9/1990 | Sharples | 222/386.5 |
| 5,029,732 | 7/1991 | Wong | 222/79 |
| 5,074,437 | 12/1991 | D'Andrade | 222/79 |
| 5,150,819 | 9/1992 | Johnson et al. | 222/79 |
| 5,155,310 | 10/1992 | Goans | 200/82 |
| 5,184,755 | 2/1993 | Brovelli | 222/79 |
| 5,184,756 | 2/1993 | Amron | 222/79 |
| 5,229,531 | 7/1993 | Song | 42/58 |
| 5,238,149 | 8/1993 | Johnson et al. | 222/79 |
| 5,244,153 | 9/1993 | Kuhn et al. | 239/587.5 |
| 5,339,987 | 8/1994 | D'Andrade | 222/79 |
| 5,360,142 | 11/1994 | Stern et al. | 222/79 |
| 5,603,361 | 2/1997 | Cuisinier | 222/79 X |

*Primary Examiner*—Gregory L. Huson
*Attorney, Agent, or Firm*—Kennedy, Davis & Kennedy

[57] ABSTRACT

A water gun (10) is provided having a pressure tank (19) in fluid communication with a coupler (20) adapted to be received upon a conventional water faucet, and a pump (42) for conveying additional air to the pressure tank. The flow of water from the water faucet draws ambient air which is compressed within the pressure tank to pressurize the water therein. The pressurized liquid is released through a nozzle (21) coupled to the pressure tank by actuation of a trigger (17).

15 Claims, 3 Drawing Sheets

TOY WATER GUN WITH AIR SIPHONING VALVE

TECHNICAL FIELD

This invention relates to toy water guns, and specifically to water guns using compressed air to expel water therefrom.

BACKGROUND OF THE INVENTION

Water guns which eject a stream of water have been a very popular toy for children. These guns have been designed to eject the stream of water in a number of ways. The most common method of ejecting water has been by a manual pump coupled to the trigger of the gun. The pump is actuated by the mere pressure exerted by one finger of an operator upon the trigger, thus the pump typically cannot generate enough pressure to eject the water a lengthy distance. Additionally, these types of pumps work on the actuation of a compression piston which create single, short bursts of water. However, many children desire the production of an extended stream of water.

Water guns have also been designed with small electric pumps which expel a stream of water from a tube coupled to the pump, as shown in U.S. Pat. Nos. 4,706,848 and 4,743,030. However, these small electric pumps typically do not generate enough force to eject the stream of water a lengthy distance.

Toy water guns have also been developed which eject a stream of water by exerting pressure on the water within the gun greater than that of ambience and controlling the release of water through a control valve. The water is expelled from the gun due to this pressure difference. The pressurization of the water has been achieved in a variety of manners. U.S. Pat. No. 3,197,070 illustrates a water gun wherein pressure is applied to the water by collapsing a water storage area. Similarly, U.S. Pat. No. 4,854,480 illustrates a water gun wherein water is forced into an elastic bladder which expands to maintain the water under pressure. The presence of air within the storage area is a problem, as a portion of the elastic force of the bladder inherently is used to compress the air rather than pressurizing the water. This use of the elastic force of the bladder is inefficient.

Lastly, water guns have been designed with manual pumps which force water from a storage reservoir to a pressure reservoir, as shown in U.S. Pat. No. 5,150,819. The conveyance of the water into the pressure tank compresses the air therein, thereby exerting pressure on the water within the storage tank. However, an operator must repetitively actuate the pump many times in order to establish an initial operating pressure. This obviously takes both time and energy to accomplish.

Accordingly, it is seen that a need remains for a water gun which can generate a long, steady stream of water in an initially efficient manner. It is to the provision of such therefore that the present invention is primarily directed.

SUMMARY OF THE INVENTION

In a preferred form of the invention a water gun comprises a pressure tank adapted to hold liquid and air and coupling means for coupling the pressure tank to a remote source of pressurized liquid so as to create a stream of liquid from the remote source to the pressure tank. The water gun also has mixing means in fluid communication with the pressure tank and the coupling means for drawing air and mixing the air with the stream of liquid from the remote source of pressurized liquid, conduit means for conveying liquid from the pressure tank to ambience, and control means for controlling the flow of liquid through the conduit means. With this construction the passage of liquid through the mixing means draws air into the stream of liquid which is then forced into the pressure tank wherein the air within the pressure tank is compressed so as to pressurize the liquid within the pressure tank.

DETAILED DESCRIPTION

Figure 1:
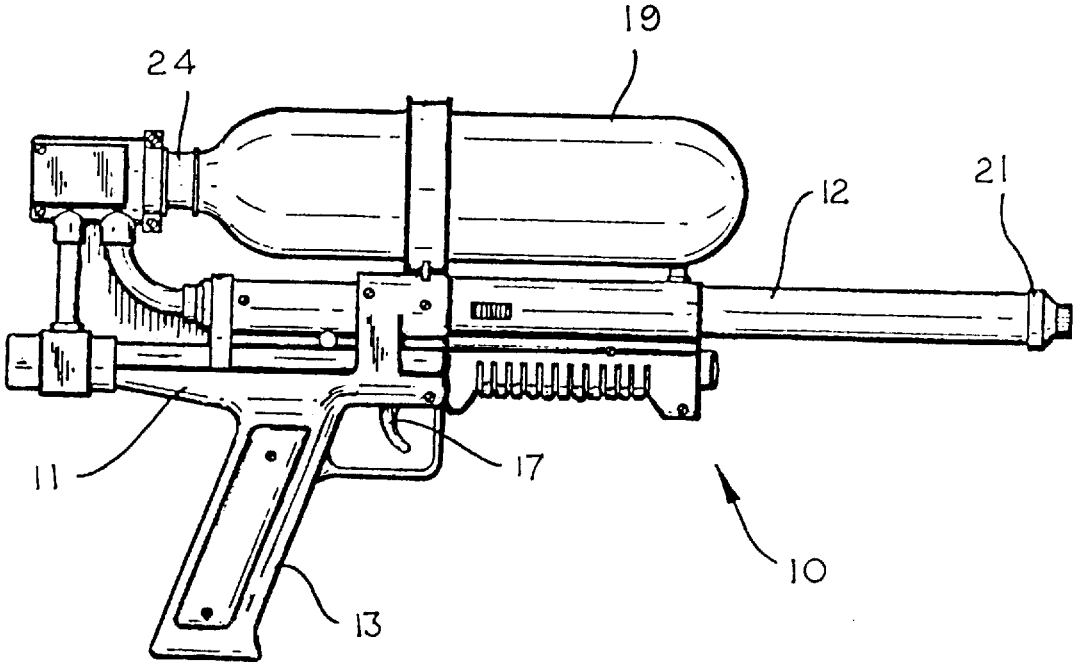
FIG. 1 is a side view of a water gun embodying principles of the invention in a preferred form.

With reference next to the drawings, there is shown a water gun 10 having a housing 11 in the shape of a gun with a barrel 13, a handle 14 and a stock 15. The gun 10 has a trigger 17, a removable liquid pressure reservoir or tank 19 mounted to the stock, a conventional nozzle 21 mounted to the end of the barrel 13, and a coupler 20 configured to be received upon a conventional water faucet, water hose, or the like through which a supply of pressurized water is accessible. The pressure tank 19 has a threaded neck 23 threadably mounted within a threaded receptor 24 within the housing. The receptor 24 has a spring biased check valve or restricted vent 26 which allows air to enter pressure tank 19. The basic construction and operation of the water gun described thus far is set forth in U.S. Pat. No. 5,074,437, which is specifically incorporated herein.

Figure 2:
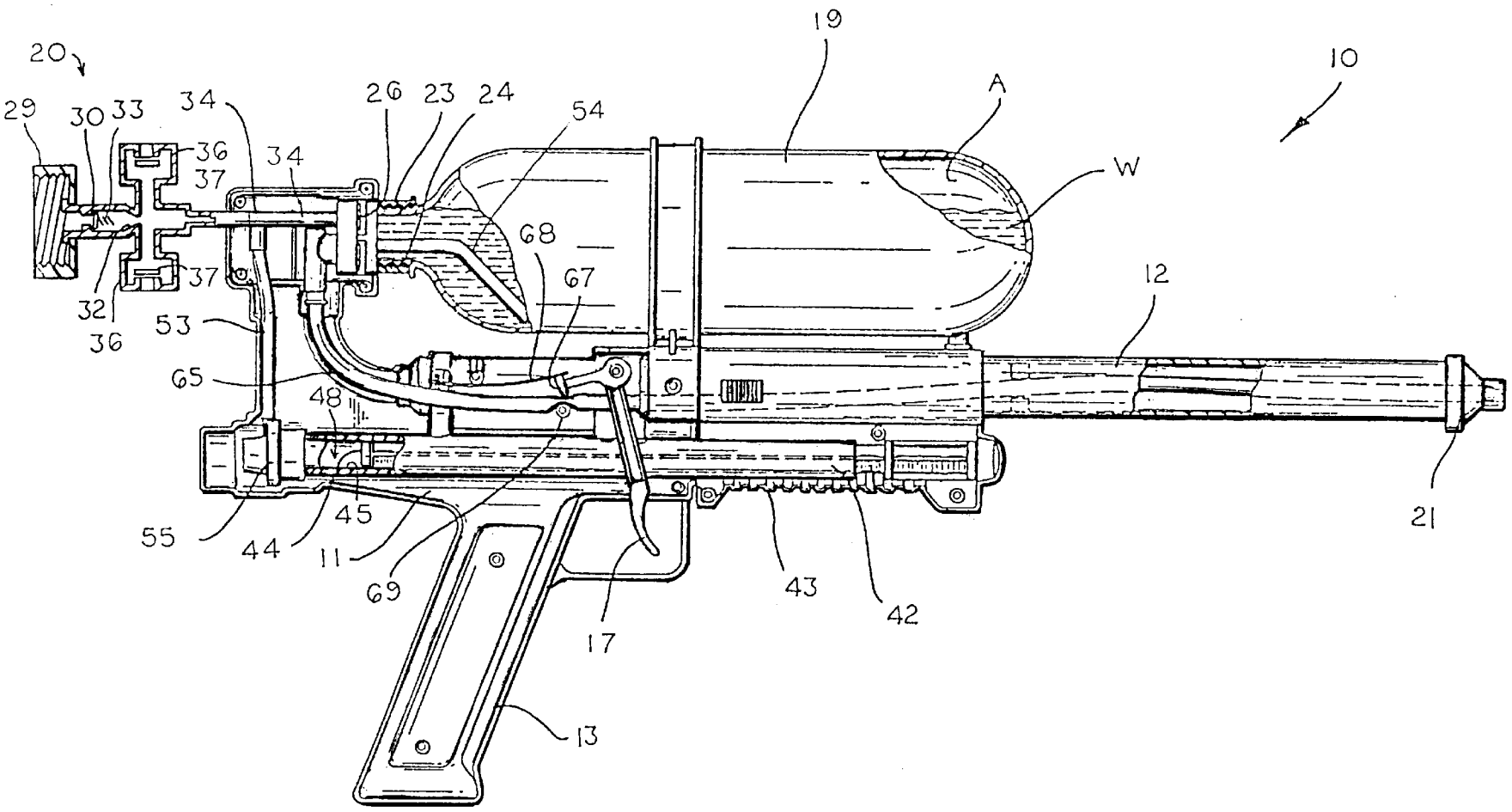
FIG. 2 is a partial cross-sectional, side view of the water gun of FIG. 1.

As shown in FIG. 2, water faucet coupler 20 has an internally threaded, annular receptor 29 coupled to a delivery tube 30 extending between receptor 29 and pressure tank 19. Annular receptor is sized and shaped to be received upon a conventional water faucet, hose or the like. Delivery tube 30 has a venturi-type tube or nozzle 32, a check valve 33 to prevent water from flowing from the delivery tube back to the receptor 29, and a T-shaped connection 34. The delivery tube 30 is coupled to two oppositely disposed air siphoning tubes 36 immediately adjacent and downstream of nozzle 32. Each air siphoning tube 36 has a check valve 37 adjacent its open end which prevent air or water from flowing from the air siphoning tube 3 to ambience.

The gun 10 has a pump 42 having a handle 43 slidably mounted to barrel 13. The handle 43 is coupled to a piston 44 slidably mounted within a cylinder 45. The cylinder 45 and piston 44 define a chamber 48. Outlet tube 53 extends from the outlet of pump 42 to T-shaped connection 34. The outlet tube 53 is coupled to a check valve 55 which allows air to pass from the pump to outlet tube 53 and prevents air or water from passing from the outlet tube into the pump. A water pick-up tube 54 mounted within pressure tank 19 extends to a flexible delivery tube 65 which extends therefrom to nozzle 21. A pivotable trigger pinch bar 67 and a spring 68 are coupled to trigger 17. The spring 68 biases pinch bar 67 against delivery tube 65. A stop 69 is positioned against delivery tube 65 opposite pinch bar 67.

In use, the liquid pressure storage tank 19 is filled with a liquid, hereinafter referred specifically to as water W, by threadably mounting receptor 29 to a conventional water faucet and actuating the water faucet to create a flow of water therefrom into the water gun. The pressurized water flows through delivery tube 30, through nozzle 32, and through the remaining portion of delivery tube 30 into pressure tank 19. As the water is expelled from venturi nozzle 32 it creates a low pressure zone immediately adjacent and downstream from nozzle 32. This created low pressure within the delivery tube draws air from ambience through check valves 37 and air siphoning tubes 36, i.e. the water passing from the nozzle siphons air into the stream of water. This air is mixed with the stream of water passing from the nozzle into pressure tank 19. Once within the pressure tank, the air and water mixture separates to form a supply of compressed air A directly above a pool of water W. The compressed air pressurizes the water to that above ambient pressure, thus creating a pressure difference. As water and air continue to enter the pressure tank the water continues to displace the air therein, thus causing the air therein to be further compressed. This further compression of the air provides additional pressure upon the water W.

Once the pressure tank is completely filled and an equilibrium is established between the pressurized water source and the pressure tank, coupler 20 is unthreaded from the water faucet. Check valve 33 prevents the pressurized water W within the gun from escaping.

The pressure tank should now be at an elevated pressure above ambience to effectively create a stream of water. However, should one wish a stronger steam of water to be produced the pump handle 43 may then reciprocally moved to force additional air into the pressure tank. The movement of the piston 44 within the cylinder 45 has two-cycle strokes, a priming stroke wherein air is drawn forth through check valves 37, air siphoning tubes 36, delivery tube 39 and outlet tube 53 and into pump 32, and a compression stroke wherein the air is displaced by the piston 44 and forced into the pressure tank through outlet tube 53 and delivery tube 39. As the piston is reciprocated within its cylinder, air is repeatedly drawn from ambience and deposited into the pressure tank 19. This may occur until the force used to drive the piston can no longer overcome the stored pressures, or the water pressure reaches a preselected pressure level which overcomes the biasing force exerted by pinch bar 67 so as to allow the water to be released through delivery tube 65. The pressurized water is prevented from escaping the pressure tank through receptor 29 by check valve 33.

To release the pressurized water from the gun the trigger 17 is manually pulled to overcome the biasing force exerted by spring 68 upon pinch bar 67. Movement of pinch bar 67 from delivery tube 65 causes the pressurized water within delivery tube 65 and pressure tank 19 to be released as a stream from nozzle 21. It should also be understood that the water gun may emit a stream of water while simultaneously pumping air through actuation of handle 43.

With the release of water the pressure within the pressure tank will naturally decrease. Once again, the actuation of the pump will draw air and force it into the pressure tank to increase the water pressure.

It should be understood that the pressure tank 19 may also be removed from the stock 15 and filled through neck 23. Should the storage tank be removed for filling it is subsequently threadably remounted to the stock. However, this manner of filling the pressure tank with water will not produce the advantage of initially pressurize the pressure tank as previously described.

Figure 3:
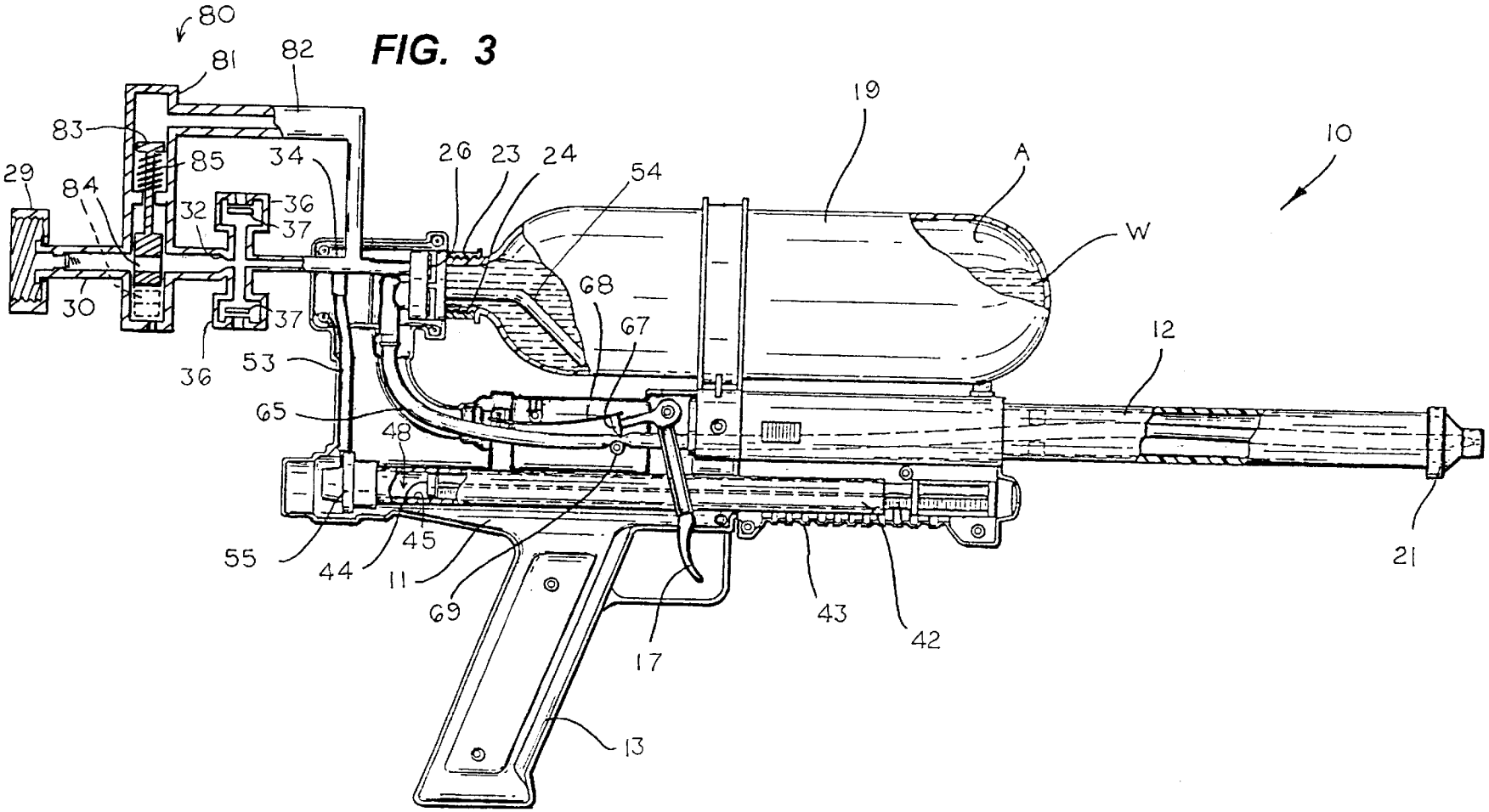
FIG. 3. is a partial cross-sectional view of an alternative embodiment of a water gun in another preferred form.

With reference next to FIG. 3, there is shown a coupler 80 in an alternative embodiment. Here, the coupler 80 has a cylindrical housing 81 has lower portion coupled to the delivery tube 30 and an upper portion coupled to a pressure tube 82 in fluid communication with pressure tank 19. A pressure sensitive piston 83, having an opening 84 therethrough, is reciprocally mounted within the housing 81 for slidable movement between a low pressure, open position, as shown in FIG. 3, and a high pressure, closed position, shown in phantom lines in FIG. 3. A spring 85 biases the piston 83 towards its open position. The bottom of housing 81 is vented to avoid compression of air therein with downward movement of the piston.

In use, the piston 83 of coupler 80 is initially spring biased to its open position to allow water to pass through delivery tube 30 and piston opening 84 to pressure tank 19. With increased pressure, the pressure within pressure tank 19, pressure tube 82 and the upper portion of housing 81 exerts a downward force upon piston 83. As the pressure reaches a threshold level it overcomes the biasing force of spring 85 so as to move the piston 83 to its closed position. With the piston in its closed position water cannot pass through opening 84 and as such water is prevented from entering the pressure tank. This prevents the overfilling or overpressurizing of the pressure tank. As the pressure within the pressure tank decreases the piston 83 will once again move to its open position through the biasing force of the spring.

It should be understood that the invention may be used with any source of pressurized water, such as a separate pressurized storage tank to which the coupler may be mounted.

It thus is seen that a toy water gun in now provided which initially pressurizes the pressure tank upon filling with water by ensuring a supply of air within the pressure tank. While this invention has been described in detail with particular references to the preferred embodiments thereof, it should be understood that many modifications, additions and deletions, in addition to those expressly recited, may be made thereto without departure from the spirit and scope of the invention as set forth in the following claims.

We claim:

1. A toy water gun comprising:

a pressure tank adapted to hold liquid and air;

coupling means for coupling said pressure tank to a remote source of pressurized liquid so as to create a stream of liquid from the remote source to said pressure tank;

mixing means in fluid communication with said pressure tank and said coupling means for drawing air and mixing the air with the stream of liquid from the remote source of pressurized liquid;

conduit means for conveying liquid from said pressure tank to ambience; and control means for controlling the flow of liquid through said conduit means, whereby the passage of liquid through the mixing means draws air into the stream of liquid which is then forced into the pressure tank wherein the air within the pressure tank is compressed so as to pressurize the liquid within the pressure tank.

2. The toy water gun of claim 1 further comprising pump means for forcing air into said pressure tank.

3. The toy water gun of claim 1 wherein said mixing means comprises a conduit, means for creating a low pressure area within said conduit, an air intake in fluid communication with said low pressure area, and a check valve for allowing the flow of air into said mixing means and preventing the flow of fluids out of said mixing means.

4. The toy water gun of claim 3 wherein said means for creating a low pressure area comprises a venturi tube.

5. The toy water gun of claim 1 wherein said coupling means comprises an internally threaded coupler adapted to be threadably mounted to a conventional water faucet and check valve means for allowing the flow of water in a direction from the faucet into said pressure tank and preventing the flow of water in an opposite direction.

6. A toy water gun comprising:

a receptor configured to be received upon an outlet for a source of pressurized water;

a pressure tank adapted to hold water and air;

conduit means extending between and in fluid communication with said receptor and said pressure tank;

mixing means coupled to said conduit having an inlet in fluid communication with ambient air for mixing ambient air with the pressurized water passing through said conduit means from said receptor to said pressure tank;

whereby the air mixed into the pressurized water is compressed within the pressure tank so as to exert a force upon the water within the pressure tank greater than ambient pressure.

7. The toy water gun of claim 6 further comprising pump means for forcing air into said pressure tank.

8. The toy water gun of claim 6 wherein said mixing means comprises means for creating a low pressure area within said conduit means, an air intake in fluid communication with said low pressure area, and a check valve for allowing the flow of air into said mixing means and preventing the flow of fluids out of said mixing means.

9. The toy water gun of claim 8 wherein said means for creating a low pressure area comprises a venturi tube.

10. The toy water gun of claim 6 wherein said receptor comprises an internally threaded coupler adapted to be threadably mounted to the conventional water outlet and check valve means for allowing the flow of water in a direction from the outlet into said pressure tank and preventing the flow of water in an opposite direction.

11. A method of pressurizing air within a pressure tank of a toy water gun comprising the steps of:

(a) coupling the pressure tank to a supply of pressurized water;

(b) creating a stream of water from the supply of pressurized water to the pressure tank;

(c) mixing air into the stream of water prior to entering the pressure tank; and (d) storing the water and air within the pressure tank in a manner so that the air therein pressurizes the water therein.

12. The method of claim 11 wherein step (c) the air is mixed into the stream of water by creating a low pressure area within the stream of water in fluid communication with ambience so that ambient air is drawn into the stream by the low pressure.

13. The method of claim 12 wherein the low pressure area is created by a venturi tube.

14. The method of claim 13 wherein the low pressure area is also created by an air siphoning tube in fluid communication with the venturi tube.

15. The method of claim 14 wherein the air siphoning tube also has a check valve to prevent air from escaping the siphoning tube to ambience.

* * * * *